United States Patent [19]

Sakakibara et al.

[11] 4,202,424

[45] May 13, 1980

[54] AUTOMOBILE SPEED CONTROL SYSTEM

[75] Inventors: Naoji Sakakibara, Chiryu; Shoji Kawata, Okazaki, both of Japan

[73] Assignee: Aisin Seiki Kabushiki Kaisha, Kariya, Japan

[21] Appl. No.: 889,692

[22] Filed: Mar. 24, 1978

[30] Foreign Application Priority Data

Mar. 24, 1977 [JP] Japan ..... 52-32498

[51] Int. Cl.[2] ..... B05K 31/00

[52] U.S. Cl. ..... 180/176; 123/102

[58] Field of Search ..... 123/102; 180/105 E, 180/176

[56] References Cited

U.S. PATENT DOCUMENTS

| | | | |
|---|---|---|---|
| 3,952,829 | 4/1976 | Gray | 123/102 |
| 3,998,191 | 12/1976 | Beyerlein et al. | 123/102 |
| 4,084,656 | 4/1978 | Abend et al. | 180/105 E |
| 4,094,378 | 6/1978 | Scheyhing et al. | 180/105 E |
| 4,133,406 | 1/1979 | Allerdist | 123/102 |

*Primary Examiner*—David Smith, Jr.

*Attorney, Agent, or Firm*—Sughrue, Rothwell, Mion, Zinn and Macpeak

[57] ABSTRACT

Automobile speed control system to maintain actual automobile speed to desired automobile speed, in which a first electrical signal indicating the actual automobile speed is compared with a second electrical signal indicating the desired automobile speed with a comparator circuit to obtain an error signal indicating speed difference between the actual and desired automobile speeds. The error signal is supplied to throttle valve control means to shift the throttle valve into a position at which the actual automobile speed equals to the desired automobile speed. The error signal, through an electrical first order lag circuit, is fed back to the comparator circuit to stabilize speed control operation of the system, whereby the prior art feedback potentiometer, in prior arts linked to the throttle valve to supply negative feedback signal to the comparator circuit is eliminated.

6 Claims, 2 Drawing Figures

AUTOMOBILE SPEED CONTROL SYSTEM

BACKGROUND OF THE INVENTION

The present invention relates to improvement in speed control systems for automobiles. More particularly, the invention relates to speed control system to maintain the speed of an automobile at stabilized desired by value by employing a negative feedback loop.

Speed controls for automobiles are now in commercial use, in which actual speed of the automobile is compared with a preselected desired value to generate a throttle position feedback signal for controlling the throttle valve at a position at which the actual speed balances with the preselected value. Generally speaking, automatic speed control of automobiles requires stabilization of the speed control system. If the stabilization should be not sufficient, so called hunting, overshoot or undershoot of the actual speed of the automobile occurs. The hunting can be prevented by deteriorating the responsibility and accuracy of the speed control system. However, the hunting can also be prevented without deteriorating this responsibility by employing negative feedback control of the throttle valve as shown in U.S. Pat. No. 3,381,771. (issued May 7, 1968). In the invention of the patent, actual speed indication signal from a tachometer generator of an automobile speedometer and a preselected desired speed indication signal from a speed set potentiometer are supplied to a comparator circuit to generate an error signal to control the throttle valve position, then the error signal is supplied to a differential amplifier circuit together with a throttle position feedback signal (the negative feedback signal) from a feedback potentiometer linked with the throttle valve. The output signal of the differential amplifier circuit is supplied to a vacuum modulator which in response thereto provides to a vacuum motor vacuum pressure related to the output signal. The vacuum motor is mechanically ganged to the throttle valve and controls its position. Thus the output differential signal of the differential amplifier regulates the position of the throttle valve. The negative feedback of the throttle valve position prevents extra movement of the throttle valve toward opening or closing. Therefore over acceleration and deceleration of the automobile are prevented. However, this negative feedback of throttle valve position is relatively difficult to implement because a transducer such as the feedback potentiometer which is linked with a throttle drive system (from an accelerator pedal to the throttle valve) and which generates a throttle position feedback signal is required, and the space to accommodate the transducer is limited (since the throttle drive system is installed in a narrow space). Moreover, electrical lead installation from the transducer to the differential amplifier circuit as well as mechanical adjustment of the linkage between the throttle drive system and the transducer are required. The feedback potentiometer may be weared out too early due to mechanical reciprocal operation or vibration, temperature, dampness and/or dust in engine room of the automobile.

Similar speed controls for automobiles are disclosed in U.S. Pat. Nos. Re. 27,324 (issued Mar. 28, 1972), 3,477,346 (issued Nov. 11, 1969), 3,485,316 (issued Dec. 23, 1969), 4,056,157 (issued Nov. 1, 1977). Negative feedback circuit without use of the feedback potentiometer, and which compares a speed error signal with an actual automobile speed signal to generate a negative feedback signal, is disclosed in U.S. Pat. No. 3,952,829 (issued Apr, 27, 1976). Also negative feedback circuit without use of the feedback potentiometer, which has a circuit means for retarding speed error signal to be supplied to desired speed signal generator circuit as the negative feedback signal is disclosed in U.S. Pat. No. 3,793,622 (issued Feb. 19, 1974).

SUMMARY OF THE INVENTION

One object of the present invention is to obtain a negative feedback signal to stabilize the speed control of the automobile without connecting the transducer to the throttle drive system. The outer object of the present invention is to provide an automobile speed control system which has a stabilized speed control characteristic and can be installed relatively readily in automobiles. These and other objects and advantages of the present invention will become readily apparent from the following detailed description.

According to the present invention, a first electrical signal which indicates the actual road speed of the automobile is compared in a comparator circuit with a second electric signal which indicates a desired speed set by a driver of the automobile. The output differential signal of the comparator circuit is fed back to the comparator circuit through a delay circuit in negative sense i.e. negative feedback as compared with the first electrical signal to supply out the output differential signal as throttle position control signal in a stabilized mode. In a preferred embodiment of the present invention, the output differential signal of the comparator circuit is negatively fed back in a form of superposition of the delayed output signal on the first signal to the comparator circuit. The delay circuit includes a resistor and a capacitor which form an electrical first order lag circuit. Thus inputs of the comparator circuit are the superposed voltage potential of the first signal level indicating the succeeding actual road speed of the automobile upon the preceding delayed output differential signal level and the second signal level indicating the desired speed set by the driver. Thus final output level of the comparator circuit shifts in gentle grade mode in response to any shift of the actual speed against the desired speed. This operation mode of the comparator circuit is well fitted with stabilized speed control of an automobile with a throttle valve position control mechanism, and gentle grade mode of the output differential signal will be designed and adjusted readily with the electrical constants of the resistor and capacitor of the delay circuit.

DESCRIPTION OF THE PREFERRED EMBODIMENT

Figure 1:
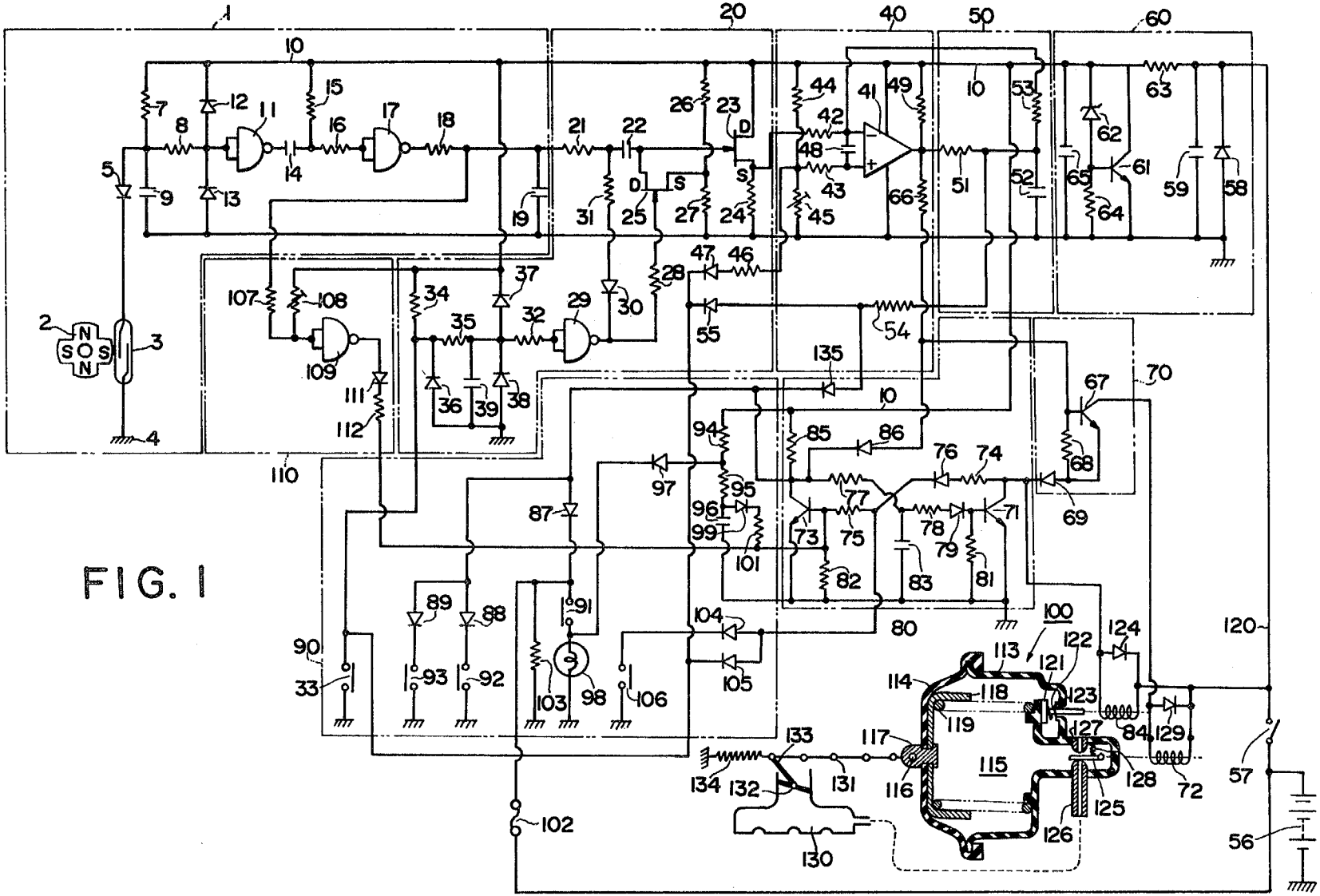
FIG. 1 illustrates an embodiment of the present invention.

Referring to FIG. 1, there is shown a preferred embodiment of the present invention, which comprises an actual speed signal generator circuit 1, a memory and comparator circuit 20, a comparator circuit 40, a delay circuit 50, a voltage control circuit 60, a power amplifier circuit 70, a self-maintaining circuit 80, a speed set control circuit 90, a vacuum actuator 100 and a speed set control prohibition circuit 110.

The actual speed signal generator circuit 1 includes a magnet 2 which is driven to rotate at the same speed as the speedometer cable of an automobile. In synchronism with the rotation of the magnet 2, a reed switch 3 opens and closes by turns repeatedly. A terminal of the read switch 3 is connected with ground 4 and the other terminal of it is connected to a connection point between a resistor 7 and a capacitor 9 through a diode 5. The resistor 7 and capacitor 9 are connected with a constant voltage line 10 and ground respectively. A terminal of a resistor 8 is connected with a connection point between resistor 7 and capacitor 9 and the other terminal of it is connected with a connection point to which the input terminal of a COS/MOS (Complementary symmetry metal-oxide semiconductor e.g. CD4011A of RCA Corporation)- NAND gate 11, anode of a diode 12 and cathode of a diode 13 are connected. The diodes 12 and 13 are connected with the constant voltage line 10 and ground respectively. The output of the NAND gate 11 is supplied to input terminal of a NAND gate 17 through a capacitor 14 and resistor 16. A terminal of a resistor 15 is connected with a connection point between the capacitor 14 and resistor 16 and the other terminal of it is connected with the constant voltage line 10. The capacitor 14 as well as resistor 15 determine a metastable state interval of a mono-multivibrator constructed with resistor 16 and NAND gate 17. A resistor 18 and a capacitor 19 are connected with output terminal of NAND gate 17 and construct an integration circuit. The magnet 2 rotates with a speed which is proportional to actual speed of the automobile. Thus ON, OFF repetition frequency of reed switch 3 is proportional to actual speed, and the voltage level at the connection point between capacitor 9 and resistor 7 pulsates between constant voltage level of line 10 and ground level. The capacitor 9 absorbs pulsation of high frequency caused by the chattering of reed segments in reed switch 3. The diodes 12 and 13 prevent application of surges to NAND gate 11. The capacitor 14 and resistor 15 form a timer circuit, which provides a constant delay time to rise input voltage level up to a threshold level of NAND gate 17 after it has fallen to ground at the output of NAND gate 11. Therefore the output of NAND gate 17 pulsates by one cycle in one ON, OFF cycle of reed switch 3. Namely NAND gate 17 operates as a mono-multivibrator and generates a series of pulses, positive pulse width of which corresponds to the constant delay time of the timer circuit and repetition rate of which is proportional to actual speed of the automobile. The capacitor 19 is charged by the pulses. Therefore voltage level of capacitor 19 indicates actual speed of the automobile.

The memory and comparator circuit 20 memorizes the second electrical signal which indicates desired speed of the automobile and compares the first electrical signal with the second electrical signal to generate an error signal which indicates speed difference between the actual one and the desired one. The circuit 20 includes an input resistor 21, a memory capacitor 22, and a first FET (Field Effect Transistor) 25 which are connected in series. The drain of a second FET 23 is connected with constant voltage line 10 and its source is connected to ground through a resistor 24. The FET 23 is employed for an impedance converter. The first FET 25 for analog switching is connected between the gate of the FET 23 and the connection point of resistors 26 and 27. The gate of FET 25 is connected to the output terminal of a NAND gate 29 through a resistor 28. The output terminal of NAND gate 29 is connected to the input terminal of memory capacitor 22 through a diode 30 and a resistor 31. The NAND gate 29 receives via resistors 32 and 35 the voltage level of line 10 through a resistor 34 or ground level through a desired speed set switch 33 of the speed set control circuit 90 fully described hereinafter. A diode 36 and a capacitor 39 are respectively connected between ground and the input and output terminals of the resistor 35. The resistor 35, capacitor 39 and diodes 36, 37 and 38 are connected to the input stage of NAND gate 29 to absorb noise toward NAND gate 29.

At open state of desired speed set switch 33 of the speed set control circuit 90, input of NAND gate 29 is high level "H" so that output of NAND gate 29 is low level "L", by which FET 25 is in its OFF state. Upon the closing of the switch 33, output of NAND gate 29 turns to high level "H" which energizes FET 25 to turn ON, and a reference voltage "C" at a connection point between resistors 26 and 27 is supplied to a terminal of capacitor 22 and gate of FET 23 through FET 25. Thus voltage difference "A-C" between voltage level "A," which indicates an actual speed at this time, and the reference voltage "C" is applied to memory capacitor 22. Thus voltage difference "A-C" is memorized in capacitor 22. Gate voltage level of FET 23 is the reference level "C", which is supplied out in an impedance conversion mode as a source voltage of FET 23 connected in source follower mode. By opening the switch 33, output of NAND gate 29 turns to low level "L" by which FET 25 turns OFF. At the same time, voltage level "A" at the input terminal of capacitor 22 (connection point between resistor 21 and capacitor 22) falls down to voltage level "B" which will be determined by a potential divider circuit of resistors 21 and 31. At this time, the gate voltage level of FET 23 falls down to "C-(A-B)". Since the gate voltage level and source voltage level of FET 23 are substantially equal, constant voltage level of "C-(A-B)" is supplied out from source of FET 23, assuming that actual speed of the automobile is constant. Thereafter if the automobile runs a downward slope and actual speed rises up to higher speed and the first signal level of capacitor 19 rises up to "A+$\alpha$", voltage level of "C-(A-B)+$\alpha$" appears at the gate and source of FET 23, because the voltage across capacitor 22 remains "A-C". Thus source voltage of FET 23 rises up by "$\alpha$" which corresponds to increase of actual speed. Otherwise if the automobile runs an upward slope and actual speed falls down to lower speed and the first signal level of the capacitor 19 falls down to "A-$\alpha$", then the voltage level of "C-(A-B)-$\alpha$" appears at gate and source of FET 23. Thus the source voltage of FET 23 falls down by "$\alpha$" which corresponds to decrease of actual speed. The memory and comparator circuit 20 thus memorizes desired speed indication signal by closing the desired speed set switch 33 and provides a superposed signal from the source of FET 23.

The superposed signal is supplied to the minus input terminal of a voltage level comparator 41 of the comparator circuit 40. The plus input terminal of comparator 41 is connected to a connection point between resistors 44 and 45 through a resistor 43. The is connection point in turn connected to the switch 33 through a resistor 46 and diode 47. A capacitor 48 connected across input terminals of comparator 41 absorbs noise. A load resistor 49 is connected between constant voltage line 10 and the output, terminal of comparator 41.

The output of the comparator 41 is at the high level "H" when input voltage level of its minus terminal is less than that of the plus terminal, and at the low level "L" when the former exceeds the latter. Switching transistor 67 in the power amplifier circuit 70 is biased to turn ON or OFF by output voltage level "H" or "L" of comparator 41 through a resistor 66. Input reference voltage level of plus terminal of comparator 41 is adjusted by resistor 45.

The delay circuit 50 includes an integration resistor 51 and capacitor 52, as well as, a feedback resistor 53. Integrated signal on capacitor 52 i.e. delayed output of comparator 41 is fed back to minus terminal of comparator 41 through resistor 53. A connection point between resistor 51 and capacitor 52 is connected with the switch 33 through a resistor 54 and diode 55.

The voltage control circuit 60 includes a diode 58 for shunting reversed polarity voltage which might be applied on a power line 120, a capacitor 59 for noise absorption, a shunt transistor 61, a Zener diode 62, a capacitor 65 for ripple absorption and resistors 63 and 64. Upon the closing of main switch 57, the voltage of power source 56 is applied to load resistor 63. The Zener diode 62 breaks down when the voltage level of line 10 exceeds the breakdown voltage level of Zener diode 62, and then transistor 61 is deeply biased to conduct in a lower impedance, which increases, the voltage drop across load resistor 63, and the voltage level of line 10 falls down to breakdown voltage of Zener diode 62. When voltage level of line 10 is under breakdown voltage of Zener diode 62, the voltage across resistor 64 is lower so that transistor 61 is slightly biased to conduct in a higher impedance, which decreases the voltage drop across load resistor 63, and voltage level of line 10 rises up. Thus voltage level of line 10 is kept constant by the operation of Zener diode 62 and transistor 61.

The collector of switching transistor 67 of the power amplifier circuit 70 is connected with a modulator valve solenoid 72 which in turn is connected to power source 56 through main switch 57. ON or OFF switching signal of high level "H" or low level "L" is applied to base of transistor 67 from comparator 41 as described hereinbefore. The emitter of transistor 67 is connected to the collector of a transistor 71 through diode 69 and to base of a transistor 73 through resistor 74, diode 76 and resistor 75.

The self-maintaining circuit 80 includes the transistors 71 and 73 which form a bistable multivibrator. The collector of transistor 71 is connected to base of transistor 73 through diode 76 and resistors 74 and 75. The collector of transistor 73 is connected to base of transistor 71 through diode 79 and resistors 77 and 78. The output of comparator 41 through resistor 66 and diode 86, the integrated signal level of capacitor 52 (delayed output of comparator 41) through resistor 54 and a diode 135, and the voltage level of line 10 through a resistor 85 are applied to the collector of transistor 73. The bases of transistors 71 and 73 are connected to ground with resistors 81 and 82 respectively. A capacitor 83 is connected between an intermediate point of resistors 77, 78 and ground. The collector of transistor 71 is connected with a release solenoid 84 which in turn is connected to power source 56 through main switch 57. The collector of transistor 73 is connected to a stop switch 91 through a diode 87 and also connected to a clutch switch 92 and a parking brake switch 93 through diodes 88 and 89 respectively.

The speed set control circuit 90 includes the desired speed set switch 33, stop switch 91, clutch switch 92, parking brake switch 93 and a resume switch 106. A stop indication lamp 98 is serially connected with stop switch 91. The junction point between lamp 98 and stop switch 91 is connected to line 10 through a diode 97 and resistor 94, which in turn connected to base of transistor 73 through resistors 95, 101 and a diode 99 and also connected to ground through resistor 95 and a capacitor 96. The junction point between stop switch 91 and diode 87 is connected to ground through a resistor 103 and power source 56 through a fuse 102. The junction point between resistor 75 and diode 76 is connected to resume switch 106 through a diode 104 and also to the desired speed set switch 33 through a diode 105. The resistors 82 and 101 are connected to output terminal of a NAND gate 109 through a resistor 112 and 111. The desired speed set switch 33, stop switch 91, clutch switch 92 and parking brake switch 93 make discharge loops of capacitor 52 with diode 55 and resistor 54, diodes 89, 135 and resistor 54, diode 88, 135 and resistor 54, and diodes 87, 135 and resistor 54 respectively when they are closed. The discharge loops clear the electric charge voltage from capacitor 52 down to a lowest one which corresponds to the released closed position of throttle valve 132.

The speed set control prohibition circuit 110 includes the NAND gate 109, diode 111 and resistor 112. The NAND gate 109 receives the actual speed indication signal from capacitor 19 of the actual speed signal generator circuit 1 through a resistor 107 and voltage of the line 10 through a resistor 108. At an actual speed of over a predetermined lower speed, the input of NAND gate 109 exceeds the threshold level of NAND gate 109 and the output of NAND gate 109 is low level "L". Whereas if actual speed falls under the predetermined lower speed, the output of NAND gate 109 turns into high level "H", which energizes transistor 73 to turn ON. Thus the speed set control protection circuit 110 detects a decrease of actual speed of the automobile under the predetermined lower value and energizes transistor 73 to turn ON. The reference predetermined lower value is adjusted by resistor 108.

The vacuum actuator 100 is employed as a transducer to convert the electrical signal for controling throttle valve position into mechanical movement of a link member connected with the throttle valve of an engine on an automobile. The actuator 100 includes a flexible diaphragm 114 hermetically sealed to a housing 113 to form a pressure compartment 115 therein. A pressure plate 118 in pressure compartment 115 is connected with flexible diaphragm 114 by caulking a rivet 117. A compression spring 119 contained by pressure compartment 115 tends to expand compartment 115 by pushing plate 118 toward the left. A release valve 121 is normally biased by a compression spring 122 to connect pressure compartment 115 to outer atmospheric pressure. Upon energizing release valve solenoid 84, release valve 121 contacts a valve seat 123 of housing 113. A diode 124 connected across solenoid 84 shunts surges which might be applied on transistor 71 or solenoid 84. A modulator valve 125 in pressure compartment 115 is normally biased by a compression spring 128 to close a vacuum nozzle 126 connected with intake manifold 130 of the engine on the automobile and opens an atmospheric pressure nozzle 127. Upon energizing modulator valve solenoid 72, modulator valve 125 is forced against compression spring 125 to open vacuum nozzle 126 in pressure compartment 115 and close atmospheric pressure nozzle 127, by which flexible diaphragm 114 is forced to compress pressure compartment 115 with negative vacuum in compartment 115. An end of a chain 131 is connected with rivet 117 through its hole 116. The other end of chain 131 is connected with a lever 133 which drives throttle valve 132. A tension spring 134 normally forces lever 133 toward closure of throttle valve 132.

By closing main switch 57, base current flows to transistor 73 from power source 56 through main switch 57, release valve solenoid 84, resistor 74, diode 76 and resistor 75. Thus transistor 73 turns ON. However, transistor 71 does not turn ON in spite of application of the voltage of line 10 to base of transistor 71 through resistors 85, 77, 78 and diode 79, because capacitor 83 delays application of base bias voltage to base of transistor 71 and turn ON of transistor 73 connects base of transistor 71 to ground. During the ON state of transistor 73, base of transistor 67 is connected to ground through diode 86 and transistor 73. Thus transistor 67 remains in the OFF state even if output of comparator 41 is high level "H". The base current through release valve solenoid 84 to transistor 73 is smaller than the energization current value or energization maintaining current value of release valve solenoid 84. Thus solenoids 72 and 84 are not energized. Therefore release valve 121 and modulator valve 125 are at the position shown in FIG. 1, and pressure compartment 115 is at atmospheric pressure by which flexible diaphragm 114 is at the outermost position shown in FIG. 1. Actual speed of the automobile will be controlled by operating throttle valve 132 to any position through an accelerator pedal and linkage members (not shown).

By closing the desired speed set switch 33, base of transistor 73 is connected to ground through resistor 77, diode 105 and switch 33. Thus transistor 73 turns OFF and transistor 71 turns ON, by which base of transistor 73 is connected to ground through resistors 74, 75 and diode 76. Transistors 71 and 73 remain ON and OFF respectively after opening of switch 33. The emitter of transistor 67 is connected to ground through diode 69 and transistor 71 which may turn ON by high level "H" of output of comparator 41. Release valve solenoid 84 is energized by the turn ON of transistor 71. Thus release valve 121 closes valve seat 123. During the closure of desired speed set switch 33, integration capacitor 52 discharges down to a low voltage level corresponding to the released closed position of throttle valve 132 through resistor 54, diode 55 and switch 33. The output high level "H" of NAND gate 29 turns ON the FET 25, which applies reference level "C" to base of FET 23. However, the plus terminal of comparator 41 is connected to ground through resistor 46, diode 47 and switch 33. Therefore, voltage level (C) of the minus terminal of comparator 41 exceeds that of the plus terminal so that comparator 41 supplies out low level "L". Thus transistor 67 does not turn ON. Modulator valve solenoid 72 is not energized.

By opening the desired speed set switch 33, output level of NAND gate 29 turns to low "L", by which FET 25 turns OFF. At this time voltage difference "A-C" is memorized in memory capacitor 22 and the source voltage level of "C-(A-B)" of FET 23 is supplied to the minus terminal of comparator 41. The voltage level of "C-(A-B)" corresponds to actual speed of the automobile at the time when the desired speed set switch 33 is opened as described hereinbefore. The voltage across resistor 45 is higher than the mean level of the voltage "C-(A-B)" as described hereinbefore. Therefore comparator 41 supplies out high level "H". Since capacitor 19 integrates pulses from NAND gate 17, ripple appears at source of FET 23 through resistor 21 and capacitor 22. Therefore output of comparator 41 pulsates between "H" and "L", which causes ON, OFF pulsation of transistor 67, which energizes and deenergizes by turns modulator valve solenoid 72. Therefore modulator valve 125 repeatedly opens and closes nozzles 126 and 127. Thus vacuum is applied to pressure compartment 115. In the moment after the opening of the desired speed set switch 33, the energized duration (time interval that valve 125 closes atmospheric pressure nozzle 127 and opens vacuum nozzle 126) of solenoid 72 is relatively long because voltage across resistor 45 is higher than the mean level of voltage "C-(A-B)" and also the feedback voltage level of integration capacitor 52 is low. Thus the vacuum (negative pressure against atmosphere) increases rapidly in pressure compartment 115. As times goes on, energized duration of modulator valve solenoid 72 decreases gradually, because feedback voltage level of integration capacitor 52 rises up gradually and voltage level of minus input terminal of comparator 41 rises gradually through capacitor 22 and FET 23. Therefore the vacuum increase in pressure compartment 115 becomes lower and lower as time goes on. Finally, the energization duration of modulator valve solenoid 72 becomes constant and holds the vacuum in compartment 115 at a constant value, whereby throttle valve 132 is held at the position at which the automobile runs at a speed which corresponds to signal level on memory capacitor 22. This throttle valve position control is proceeded in a short time. Thereafter if actual speed of the automobile rises up and voltage level of capacitor 19 rises up, the minus input voltage of comparator 41 rises up in correspondence with increase of actual speed. Thus duration of high level "H" of pulsating output of comparator 41 as well as energization duration of solenoid 72 decreases in synchronism with discharge of capacitor 52. Therefore vacuum in compartment 115 decreases gradually to operate throttle valve 132 toward closed position. During this operation capacitor 52 continues to discharge and actual speed of the automobile decreases gradually. Finally, the energization duration of solenoid 72 becomes shorter and constant to hold the vacuum in compartment 115 at a constant lower value, whereby throttle valve 132 is held at a position at which the automobile runs at the speed which corresponds to signal level on memory capacitor 22. In another case if actual speed of the automobile falls down and voltage level of capacitor 19 falls down, the minus input voltage of comparator 41 falls down in correspondence with decrease of actual speed. Thus duration of the high level "H" of pulsating output of comparator 41, as well as energization duration of solenoid 72, become longer. Therefore vacuum in compartment 115 increases to operate throttle valve 132 toward full opened position. However, feedback voltage of capacitor 52 rises up by integration of the output "H" of longer duration. Therefore the "H" duration of pulsating output of comparator 41, as well as energization duration of solenoid 72, decreases gradually from longer one. Finally, the energization duration of solenoid 72 becomes longer constant one to hold vacuum in compartment 115 at a constant higher value, whereby throttle valve 132 is held at a position at which automobile runs at the speed which corresponds to signal level on memory capacitor 22. As described hereinbefore, constant speed control of the automobile is processed automatically by the system shown in FIG. 1 after acceleration or deceleration of the automobile to a desired speed and the closing of the desired speed set switch 33 at the correct moment.

Thereafter, alteration of the speed set in the system is readily possible by accelerating or decelerating the automobile speed up to or down to a desired higher or lower one through the accelerator pedal and linkage members (not shown) and operating the desired speed set switch 33. On the other hand, the voltage level of the plus terminal of comparator 41 falls down to a lower level during closure of the switch 33 through resistor 46, diode 47 and switch 33. Therefore, the duration of level "H" of the pulsating output of comparator 41 becomes shorter, so that vacuum in pressure compartment 115 decreases gradually during closure of the switch 33, and throttle valve 132 moves toward the closed position to decelerate actual speed. Thus the longer the closure of the switch 33, the lower the actual speed, whereby the memorized desired speed on the memory capacitor 22 at opening of the switch 33 is a lower one as compared with the preceding memorized one. Therefore, the speed level to be memorized on the capacitor 22 is readily adjusted down to a lower one by the closure time duration of the desired speed set switch 33. During the closure of the switch 33, the capacitor 52 discharges quickly through diode 55 and resistor 54 down to the lowest voltage level which corresponds to the released, closed position of throttle valve 132.

The constant speed control operation is cancelled by momentary closure of stop lamp switch 91, clutch switch 92 or parking brake switch 93. Assuming that the stop lamp switch 91 is closed, capacitor 52 discharges down to the lowest voltage level through resistor 54, diode 135, 87 and lamp 98, and transistor 73 is biased to turn ON by voltage level of line 10 through resistor 94, 95, diode 99 and resistor 101 (the serial connection of the resistor 95, diode 99 and resistor 101 is shunted to ground through diode 97 and stop lamp 98 in the closed state of the switch 91). Thus transistor 71 turns OFF. Therefore, release valve solenoid 84 is deenergized and release valve 121 moves from valve seat 123. Then the inner pressure of pressure compartment 115 rises up to atmospheric pressure rapidly, which drive flexible diaphragm 114 toward the left position shown in FIG. 1. The throttle valve 132 closes rapidly. At the same time, base of transistor 67 is connected to ground through diode 86 and transistor 73. The transistor 67 turns OFF and modulator valve solenoid 72 is deenergized. The capacitor 52 discharges through diodes 135, 87, switch 91 and lamp 98. Capacitor 96 absorbs surges which may arise on electrical wiring of stop lamp 98.

Assuming that the clutch switch 92 or parking brake switch 93 is closed momentarily, capacitor 52 discharges through resistor 54, diode 135 and diode 88 or 89, and transistors 71 and 73 turn OFF and ON respectively because base current to transistor 71 through resistors 77, 78 and diode 79 is shunted to ground through diode 88 and switch 92, or, diode 89 and switch 93.

To drive the automobile with automatic constant speed control after brake operation or clutch operation i.e. after momentary closure operation of the switch 91, 92 or 93, the driver momentarily closes resume switch 106. By closing the resume switch 106, base current to transistor 73 through resistor 75 is shunted by diode 104 and switch 106. Thus transistor 73 turns OFF and transistor 71 turns ON. Therefore release valve solenoid 84 is energized, and modulator valve solenoid 72 is energized in correspondence with the pulsating output of comparator 41. Thereafter, the system operates in constant speed control mode.

If actual speed falls down under a predetermined speed and the input voltage level of NAND gate 109 falls below the threshold level of NAND gate 109, the output thereof switches to high level "H". This high level output of NAND gate 109 is applied to base of transistor 73 through diodes 111 and 112. Then transistor 73 turns ON and transistor 71 turns OFF. Thus constant speed control operation is cancelled. This cancellation prevents abrupt acceleration of the automobile which might occur without the speed set control prohibition circuit 110 if the speed signal from the actual speed signal generator circuit should accidentally rapidly fall or disappear.

The fuse 102 of lamp circuit (98) may be opencircuited, in which case base current of transistor 71 is shunted through diode 87 and resistor 103. Thus transistor 71 turns OFF and the constant speed control operation is cancelled.

The vacuum applied to nozzle 126 from intake manifold 130 does not fluctuate substantially. And even if the vacuum in intake manifold 130 varies, it does not cause erroneous control of actual speed because the vacuum in pressure compartment 115 is controlled so as to maintain the constant speed memorized on memory capacitor 22.

The delay circuit 50 accumulates or integrates output pulses from comparator 41 and provides input terminal of memory capacitor 22 with the integrated voltage level of capacitor 52 as a negative feedback signal as described hereinbefore. The integrated voltage of capacitor 52 is constant during the time when the automobile runs at the desired speed memorized on the memory capacitor 22. When actual speed falls down from the desired speed, duration of high level "H" of the pulsating output of comparator 41 becomes longer, and inner vacuum of pressure compartment 115 increases gradually to increase actual speed. However increase of actual speed delays an increasement of an inner vacuum of compartment 115. The integrated voltage level of capacitor 52 gradually rises up during increase of the inner vacuum, which raises the up voltage of input terminal of memory capacitor 22 gradually, and actual speed rises up gradually. Then the high level "H" duration of pulsating output of comparator 41 becomes shorter gradually, and vacuum increase in pressure compartment 115 as well as charging rate of capacitor 52 are decelerated gradually. Finally, at the desired speed, rise of voltage on capacitor 52 and of the inner vacuum of pressure compartment 115 comes to a stop. In this manner, integration capacitor 52 provides the input terminal of memory capacitor 22 with a negative feedback signal to limit duration of the acceleration signal fed to actuator 100 and removes throttle valve 132 smoothly in a stabilized mode to a new position at which the automobile runs at the desired speed. When actual speed rises up from the desired speed, duration of high level "H" of pulsating output of comparator 41 becomes shorter, and the inner vacuum of pressure compartment 115 decreases gradually to decrease actual speed. However decrease of actual speed delays from decreasment of inner vacuum of compartment 115. The integrated voltage level of capacitor 52 gradually falls down during decrease of the inner vacuum, by which the voltage of the input terminal of memory capacitor 22 falls down gradually, and actual speed falls down gradually. Then the high level "H" duration of the pulsating output of comparator 41 becomes longer gradually, and the vacuum decrease in pressure compartment 115 as well as discharging rate of capacitor 52 are decelerated gradually. Finally at the desired speed, the decreasing of the voltage on capacitor 52 and of the inner vacuum of pressure compartment 115 come to a stop. In this manner, integration capacitor 52 provides the input terminal of memory capacitor 22 with negative feedback signal to limit duration of the deceleration signal to actuator 100 and moves throttle valve 132 smoothly in a stabilized mode to a new position at which automobile runs at the desired speed. The system thus controls throttle valve 132 in phase leading mode with the delay circuit 50. Without the negative feedback signal of the delay circuit 50, over-acceleration or-deceleration may occur due to the delay of actual speed controlled by throttle valve 132 and actuator 100 and thus hunting of actual speed may occur.

The comparator circuit 40 in the system shown in FIG. 1 is employed for controlling the inner vacuum of compartment 115 with modulator valve solenoid 72 in duty-cycle operation mode. The output positive pulse duration of comparator 41 corresponds to an error signal level which indicates the difference between actual speed and the desired speed memorized on capacitor 22.

The discharge loops for feedback capacitor 52 from resistor 54 to switches 33, 91, 92 and 93, during closure of the switches 33, 91, 92 and 93, clear the preceding integrated feedback voltage from the capacitor 52 down to the lowest voltage level which corresponds to the released, closed position of throttle valve 132. This operation of the discharge loops resume operation of comparator 41 so as to operate it in delayed negative feedback mode in correspondance with the succeeding memorized desired speed signal level on memory capacitor 22 after opening of the switches 33, 91, 92 and 93. Without the discharge loops a voltage which corresponds to the preceding memorized desired speed signal may remain on capacitor 52 after momentary closure of the switches 33, 91, 92 and 93 and be applied to comparator 41 without delay. This may deteriorate acceleration of actual speed up to the succeeding desired speed memorized on capacitor 22.

Figure 2:
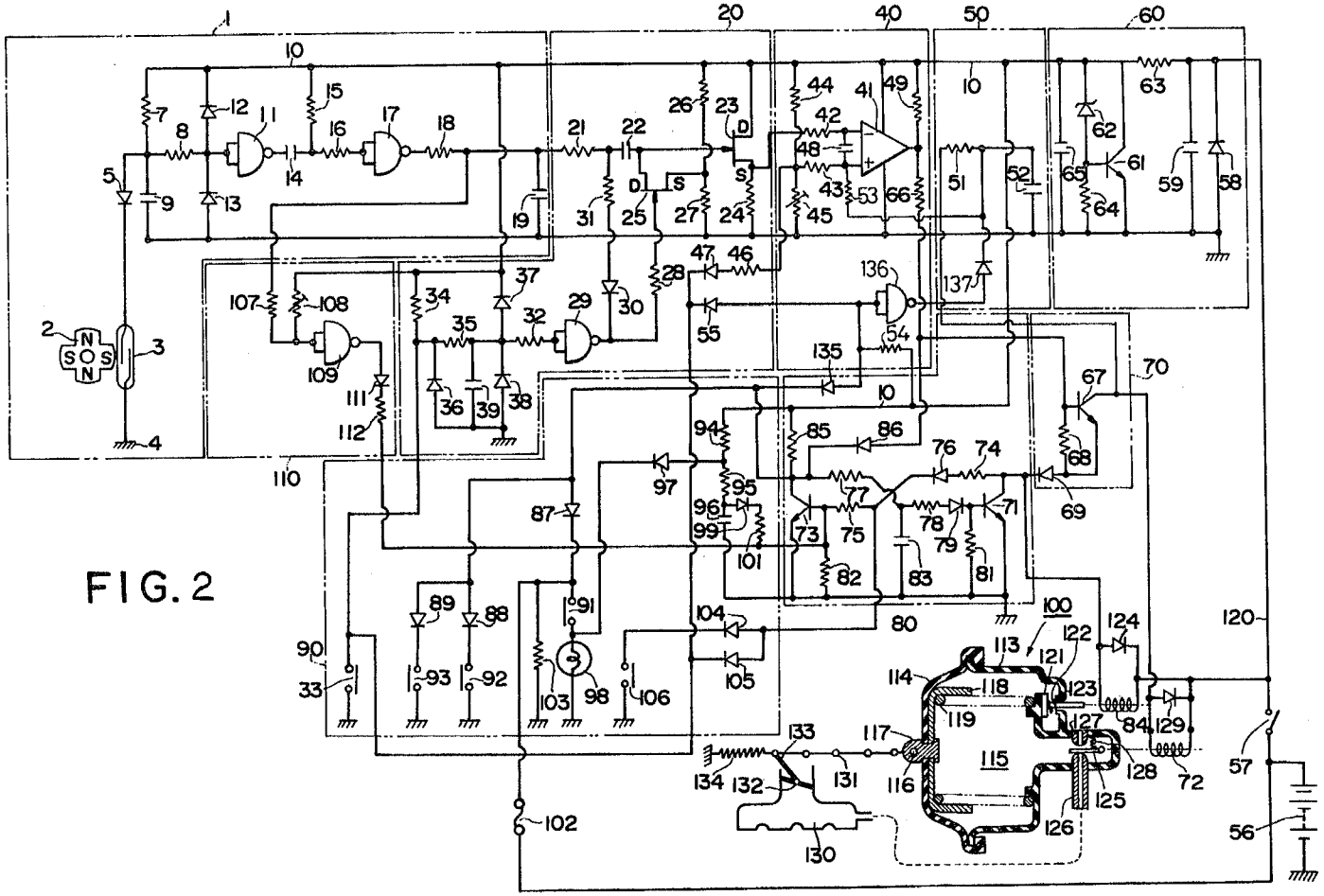
FIG. 2 illustrates a modified embodiment of the present invention.

In the modified embodiment shown in FIG. 2, resistor 51 of the delay circuit 50 is connected with the collector of transistor 67 in the power amplifier circuit 70. Resistor 53 is connected with the plus input terminal of comparator 41. The connection point between resistor 51 and capacitor 52 is connected to the output of additional NAND gate 136 through a diode 137, and the input terminal of NAND gate 136 is connected with anode of the anodes 55 and 135, as well as to constant voltage line 10 through resistor 54. The other elements shown in FIG. 2 are connected with each other as shown in FIG. 1. When the switches 33, 91, 92 and 93 are opened as shown in FIG. 2, input of NAND gate 136 is high "1" by which output of NAND gate 136 is low "0". In this case the output low level "0" of NAND gate would not cause discharge of capacitor 52 because diode 137 interrupts the discharge of capacitor 52 toward NAND gate 136. At the time when the desired speed set switch 33 is closed, input of NAND gate 136 falls to ground "0" through diode 55 and the switch 33, and the output of NAND gate 136 turns to high "1" which charges capacitor 52. The output high "1" level of NAND gate is so determined as to hold the voltage level of capacitor 52 at a constant one which corresponds to closed position of throttle valve 132. Similarly, the voltage level of capacitor 52 is reset to an upper constant one which corresponds to the closed position of throttle valve 132 after closure of the switch 33. This reset of the voltage level of capacitor 52 likely occurs when one of the switches 91, 92 and 93 is closed. In the constant speed control mode of the system shown in FIG. 2 (switches 33, 91, 92 and 93 are opened), voltage level of capacitor 52 is inversely proportional to throttle position. When actual speed falls under the desired speed memorized on capacitor 22, ON duration of transistor 67 becomes longer and capacitor 52 discharges through resistor 51, transistor 67, diode 69 and transistor 71. This causes fall down of the plus input voltage level of comparator 41, before actual speed rises up to the desired speed memorized on capacitor 22, as if actual speed has risen to the desired speed. Thus, over-acceleration is prevented. When actual speed rises over the desired speed, On duration of transistor 67 becomes shorter and the voltage level of capacitor 52 rises up. This causes rise up of the plus input voltage level of comparator 41, before actual speed falls down to the desired speed, as if actual speed has fallen to the desired speed. Thus, over-deceleration is prevented.

In the embodiment shown in FIG. 2, over-acceleration or deceleration of automobile speed is prevented with the negative feedback signal from capacitor 52. Voltage level of capacitor 52 is reset to a constant voltage level which corresonds to the closed position of throttle valve 132 during closure of the switches 33, 91, 92 and 93. This reset of the voltage level on capacitor 52 resumes operation of comparator 41 so as to operate it in delayed negative feedback mode in corresponds with the succeeding memorized desired speed signal level on memory capacitor 22 after opening of the switches 33, 91, 92 and 93. Without the reset circuit including NAND gate 136 and diode 137, a voltage which corresponds to the preceding memorized desired speed signal may remain on capacitor 52 after momentary closure of the switches 33, 91, 92 and 93 and be applied to comparator 41 without delay. This may cause rapid acceleration up to the preceding memorized desired speed after momentary closure of the switches 33, 91, 92 and 93.

As will be understood from the foregoing description, constant speed control operation is stabilized with the negative feedback signal from the delay circuit 50 without employing a feedback potentiometer which generates a throttle valve position indication signal.

Obviously many modifications and variations of the present invention are possible in the light of the above teachings; for example, the actuator 100 may be replaced by an electrical motor unit for digital position control. It is therefore to be understood that, within the scope of the appended claims, the invention may be practiced otherwise than as specifically disclosed.

The invention claimed is:

1. Automobile speed control system for automatically controlling the speed of an automobile and comprising speed control selector means for setting and cancelling a desired speed, an actual speed signal generator circuit which generates a first electrical signal indicating actual automobile speed, circuit means providing a second electrical signal which indicates desired automobile speed, circuit means providing a negative feedback signal, comparator circuit mean combining said first, second and negative feedback signals to provide an error signal, and a means to convert the error signal to provide an error signal, and a means to convert the error signal to mechanical movement of a throttle valve, characterized in that the circuit means providing the negative feedback signal comprises delay circuit means for receiving the error signal from the comparator circuit means and supplying the delayed error signal as the negative feedback signal to the comparator circuit means, and in that said speed selecting control means comprises switch means for resetting the level of the feedback signal to a level corresponding to the released, closed position of the throttle valve upon setting or cancelling a desired speed.

2. Automobile speed control system as claimed in claim 1 wherein the comparator circuit means includes a comparator which generates a pulsating signal, the high level duration of which corresponds to the actual automobile speed deviation from the desired automobile speed.

3. Automobile speed control system as claimed in claim 1 wherein the delay circuit is an electrical first order lag circuit including at least a resistor and a capacitor, the voltage on said capacitor being the feedback signal.

4. Automobile speed control system as claimed in claim 3, wherein said switch means includes one or more speed set control switches, and wherein the capacitor is connected with said switch means for resetting and holding the voltage level of the capacitor to a constant one corresponding to the released, closed position of the throttle valve when said one or more speed set control switches is operated.

5. Automobile speed control system for automatically controlling the speed of an automobile and comprising:

speed control selector means for setting and cancelling a desired speed;

an actual speed signal generator circuit which generates a first electrical analog signal having a ripple thereon and indicating actual automobile speed;

circuit means providing a second electrical signal which indicates desired automobile speed;

an electrical first order lag circuit, including a resistor, capacitor and discharge loop of the capacitor, and providing a negative feedback signal;

a comparator combining said first, second and negative signals to provide the electrical first order lag circuit with a pulsating signal, the high level duration of which corresponds to the actual automobile speed deviation from desired automobile speed; said speed control selector means comprising switch means for resetting the level of the feedback signal to a level corresponding to the released, closed position of the throttle valve upon setting or cancelling a desired speed;

vacuum actuator means including at least a pressure compartment formed in a housing member and a flexible diaphragm, a compression spring which drives the flexible diaphragm to expand the pressure compartment, a vacuum nozzle for connecting the pressure compartment to an intake manifold, an atmospheric pressure nozzle for connecting the compartment to atmosphere, a modulator valve movable between a first position, at which it closes the vacuum nozzle and opens the atmospheric pressure nozzle, and a second position at which it opens the vacuum nozzle and closes the atmospheric pressure nozzle, and a solenoid which is energized with said pulsating signal of said comparator so as to drive the modulator valve toward the second position; and linkage means connecting said flexible diaphragm to said throttle valve.

6. Automobile speed control system as claimed in claim 3 wherein said switch means discharges said capacitor to said constant voltage level.

* * * * *